United States Patent [19]

Hale

[11] 4,092,958

[45] June 6, 1978

[54] INTERNAL COMBUSTION ENGINE

[75] Inventor: David Jerry Hale, Pickett, Wis.

[73] Assignee: Brunswick Corporation, Skokie, Ill.

[21] Appl. No.: 610,319

[22] Filed: Sep. 4, 1975

[51] Int. Cl.[2] ..... F02B 33/07

[52] U.S. Cl. ..... 123/73 PP; 123/55 US; 123/73 A

[58] Field of Search ..... 123/73 R, 73 A, 73 PP, 123/55 UX, 55 UE, 55 UF, 55 US

[56] References Cited

U.S. PATENT DOCUMENTS

| | | | |
|---|---|---|---|
| 1,172,473 | 2/1916 | McCornack | 123/73 A |
| 1,283,970 | 11/1918 | Thomas | 123/55 US |
| 2,179,683 | 11/1939 | Brebeck | 127/73 A |
| 2,189,357 | 2/1940 | Call | 123/73 A |
| 2,702,534 | 2/1955 | Keylwert | 123/55 UF |
| 3,166,054 | 1/1965 | Conover | 123/55 US |
| 3,280,805 | 10/1966 | Muller | 123/55 US |
| 3,643,637 | 2/1972 | Strossner et al. | 123/73 A |
| 3,752,129 | 8/1973 | Kobayashi et al. | 123/73 A |
| 3,942,489 | 3/1976 | Meyer | 123/73 PP |

*Primary Examiner*—Charles J. Myhre
*Assistant Examiner*—David D. Reynolds
*Attorney, Agent, or Firm*—Andrus, Sceales, Starke & Sawall

[57] ABSTRACT

A sixty degree, V-6 engine for an outboard motor includes loop scavenging and charging with a pair of oppositely located input passageways with differently angles sidewalls and which provide progressive, smooth constriction to the charging port to establish a highly effective velocity pattern across the top of a flat piston. Cast "Blister" cylinder liners with integral ports are integrally cast into an aluminum block. The block is cast with a single manifold between the two cylinder blanks. A milling cutter is located within the manifold to open the exhaust passageways. A T-shaped manifold is secured to close the manifold and define a pair of separate exhaust passageways. The cylinders are rotated to align the upper and lower inlet ports and particularly to locate the exhaust port projecting downwardly into a center manifold. Adjacent piston rods are mounted upon a common crankshaft pin. In high speed racing outboards the engine is fired with an inverse firing order from the lowermost to the uppermost cylinder.

26 Claims, 20 Drawing Figures

1
12
11
2
31
3
67
66
6
63
24
13
15
16
17
20
17'
18'
18
30

Fig. 2
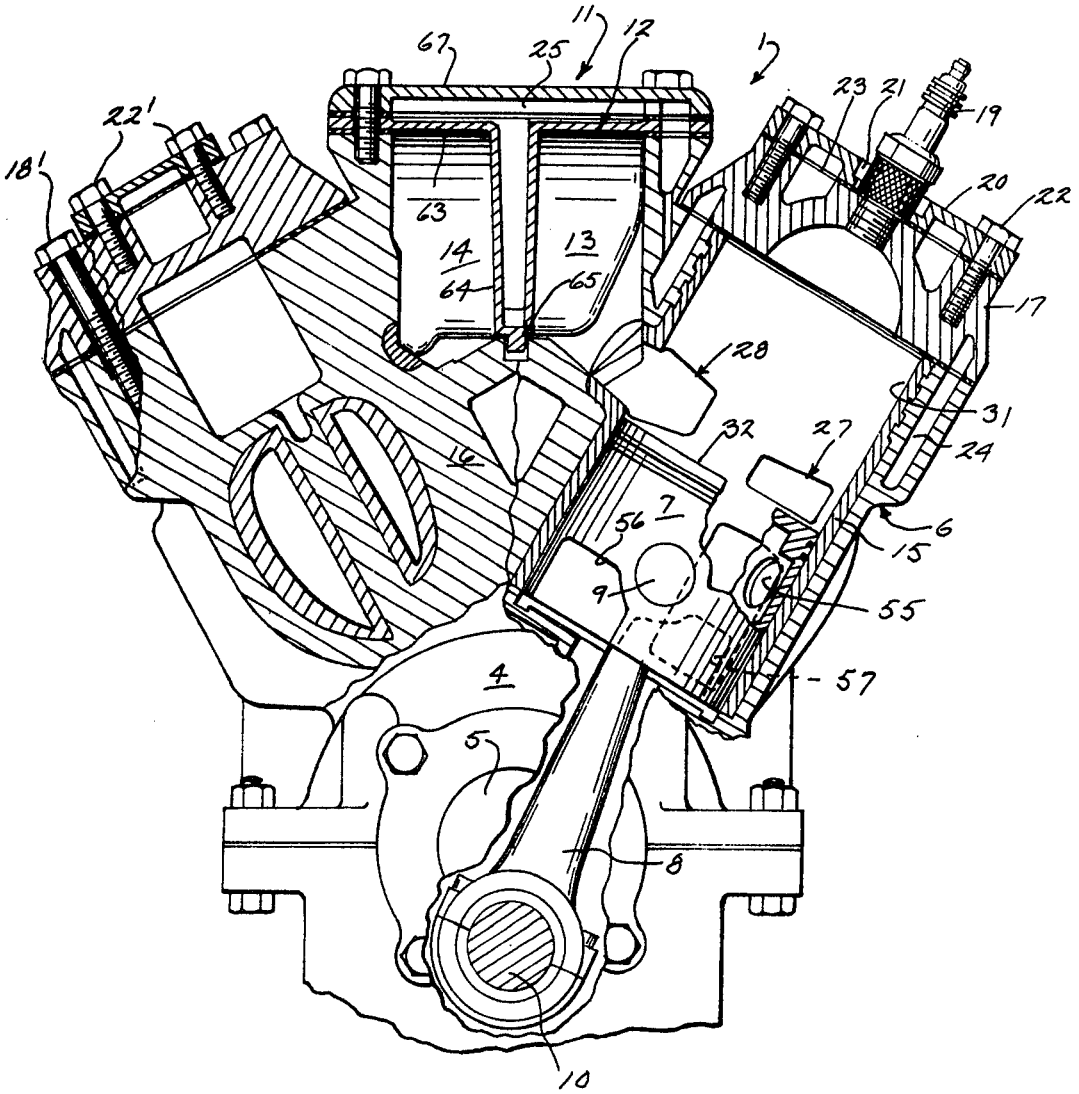
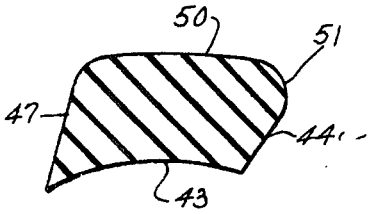
Fig. 11
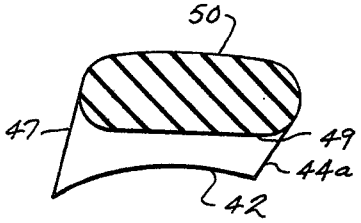
Fig. 11a
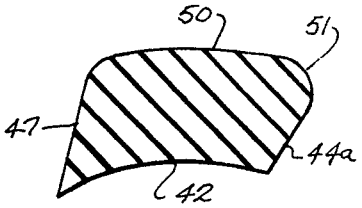
Fig. 11b

Fig. 4
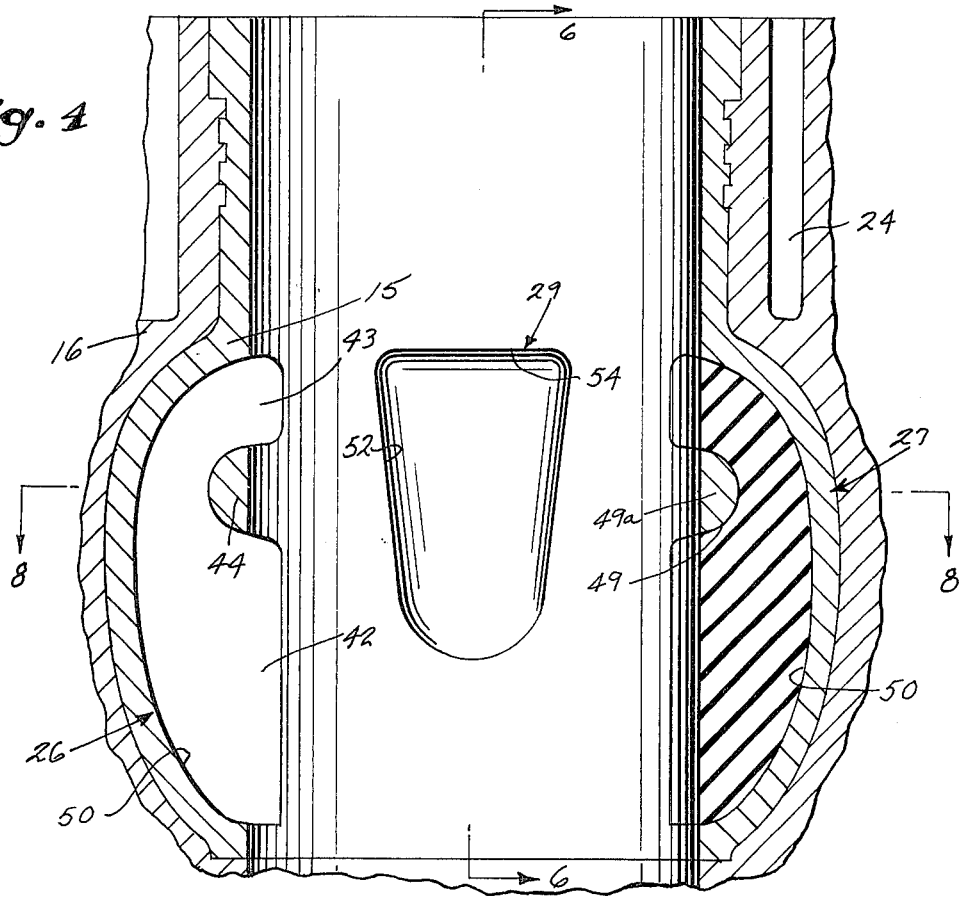
Fig. 6
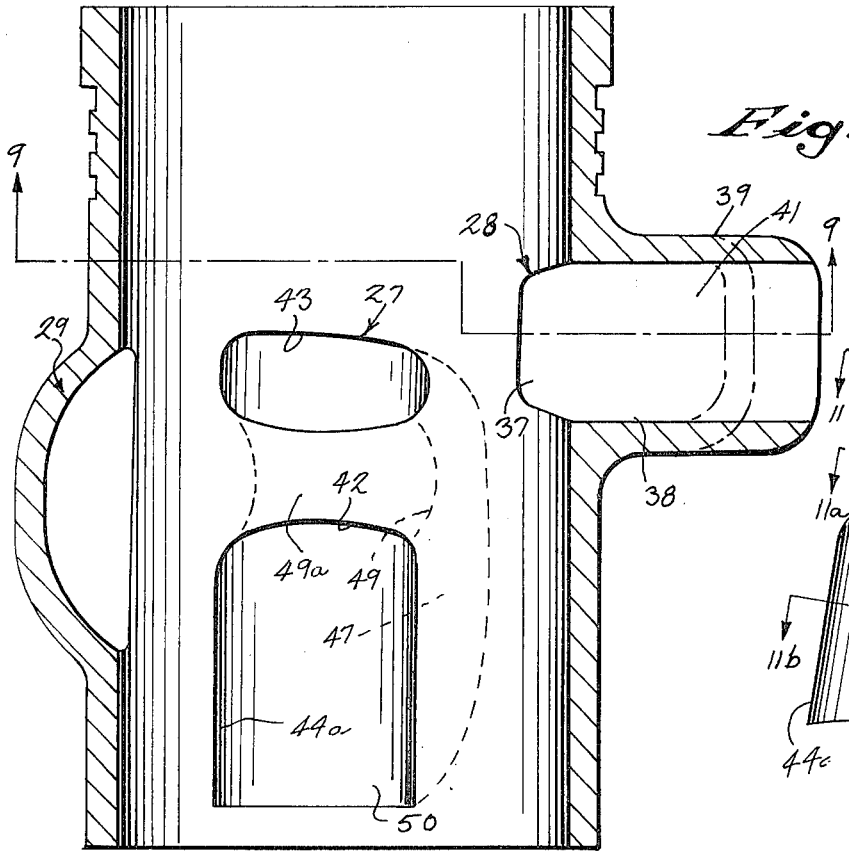
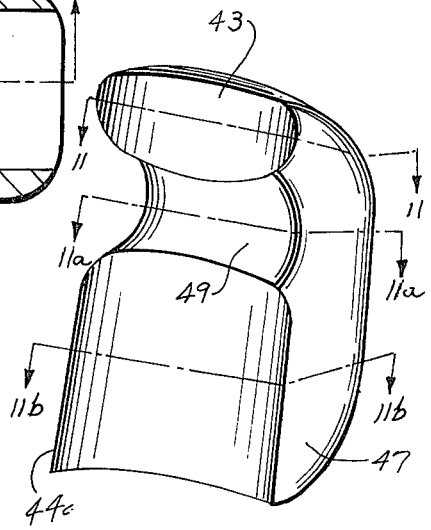
Fig. 7

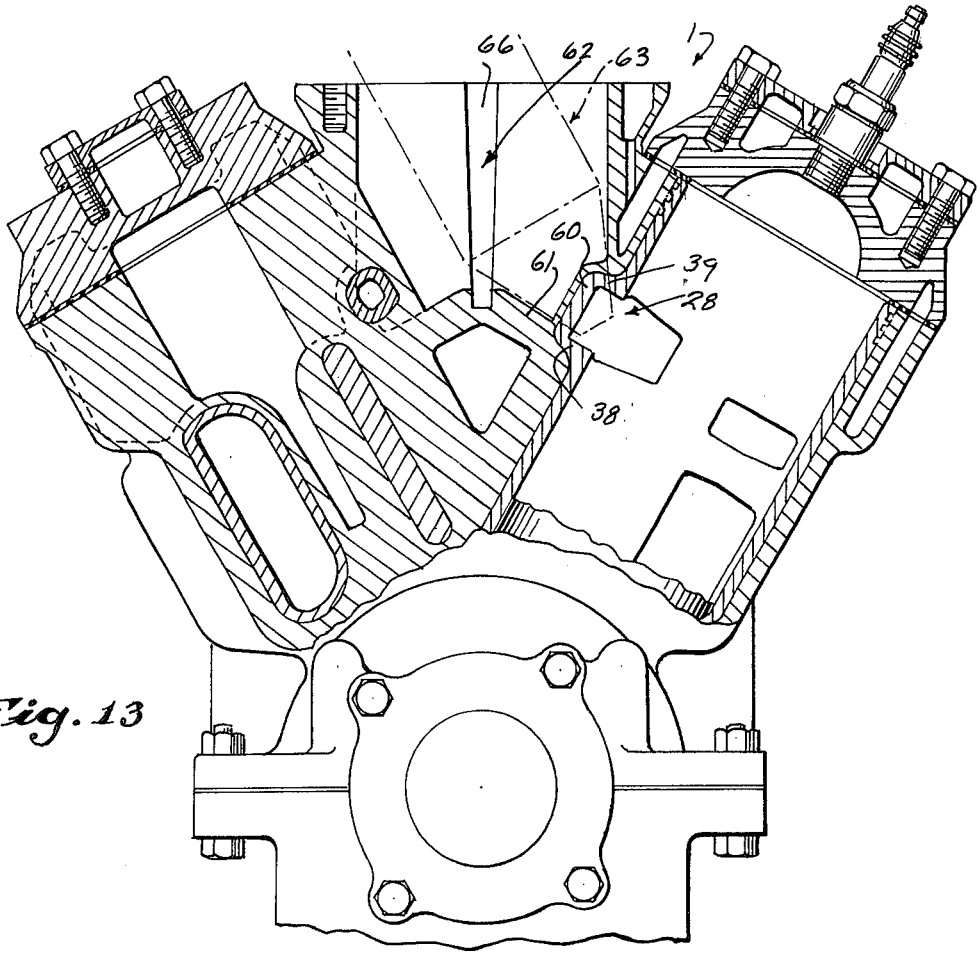
Fig. 13
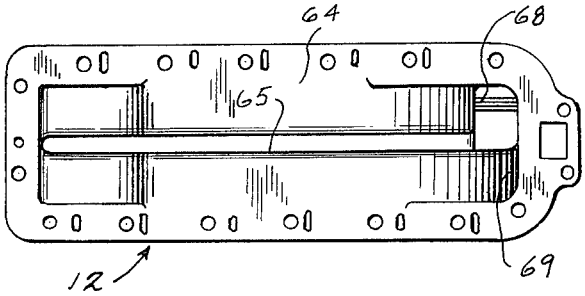
Fig. 14
Fig. 15
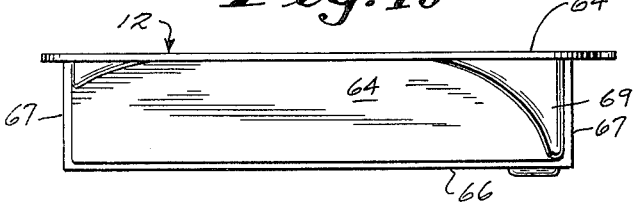
Fig. 17
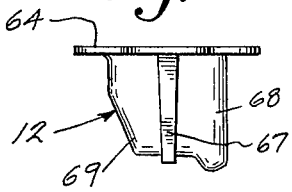
Fig. 16
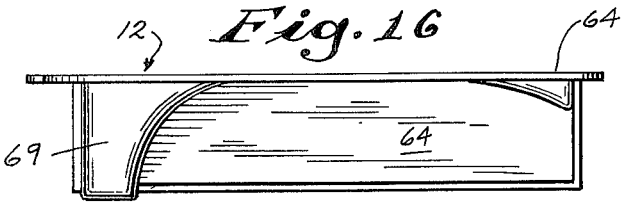
Fig. 18
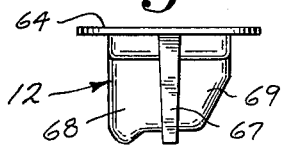

INTERNAL COMBUSTION ENGINE

BACKGROUND OF THE INVENTION

This invention relates to a two-cycle internal combustion and particularly a six cylinder V-engine with cylinder banks for mounting as a part of an outboard motor.

A V-engine employs a pair of cylinder banks angularly oriented with respect to a common crankcase. V-engines generally employ a centrally located exhaust manifold chamber with a central wall providing individual exhaust chambers for each bank. This limits the space and may require special machining and the like because of the restricted entrance to the individual chamber for each cylinder bank.

In outboard motors, the engine is mounted to the top of the driveshaft housing and enclosed within a decorative sound deadening cowl.

The V-shaped engine does permit lowering of the profile of the engine. However, the conventional ninety degree V-engine significantly increases the width of the engine. Increasing the number of cylinders in each bank tends to create an OMC overall bulky appearance of the powerhead.

The engines for outboard motor units and the like are of the two-cycle construction with pressurized crankcase charging of the cylinders. The charge is introduced in either of two distinct methods known respectively as cross charging and scavenging and as loop charging and scavenging. Conventional cross charging and scavenging permits simplified manufacturing and minimizing of cost. In such systems, a deflector piston is employed to properly expose the exhaust port means and the input port means, which are located on opposite sides of the cylinder. The input charge, which may be a fuel-air charge or only air in fuel injection systems, is derived from the pressurized crankcase and moves across the piston and is then deflected upward to scavenge the exhaust gases while introducing the new charge. Although simple and relatively inexpensive, the system does not provide a highly efficient and effective scavinging and introduction of the new charge.

Loop scavenging is generally more efficient and thus produces a greater power output per cubic inch of piston displacement with a smaller fuel usage per horsepower per hour consumption when compared to cross scavenged engines. In loop scavenging, a pair of side input ports oppositely located in the cylinder directs the charges toward the rear of the cylinder and with a finger port develops a loop path through the cylinder with a wave moving from the back of the cylinder up the combustion chamber then back down to the exhaust port on the opposite side of the cylinder. Thus, the incoming charges meet with each other and with the upward charge from the finger port adjacent to back wall of the cylinder sweep upwardly across the back of the cylinder and then over and downwardly in a distinct loop to the exhaust port. This develops a velocity pattern over the face of the piston which is a maximum at the back wall to a negative pressure created at the exhaust port. Although more efficient, the opposed dual input porting increases the overall height of the cylinder banks and thus further complicates the design of a compact, aesthetically pleasing powerhead for an outboard motor. This is, of course, particularly true in V-engines where it is generally desirable to minimize the height because of the increased width. A loop scavenging porting is also somewhat more complicated and costly and maximum efficiency is desirable to compensate therefore. The loop scavenger system is, therefore, desirable for providing higher specific power levels, lower fuel consumption, and greater reliability particularly with the design simplicity of this invention as presently set forth.

Further, V-engines are generally tuned with individual exhaust chambers cast into the block. The exhaust passageway openings are formed after casting and, because of the restricted size of the exhaust chamber, generally require special machining with a resultant expense.

Although V-engines do, therefore, have advantages for outboard motors and the like, many disadvantages have existed which have discouraged their implementation and use by certain manufacturers.

SUMMARY OF THE PRESENT INVENTION

The present invention is particularly directed to an internal combustion engine having a loop scavenging and charging system which is adapted to practical production processes and, more particularly, is directed to a special exhaust and supply-port configuration to establish an efficient scavenging and charging loop with the cylinders closely nested to minimize the height of a vertical in-line cylinder bank.

In a particularly novel aspect in one embodiment of the invention, the cylinders with the input-output ports and passageways are defined by "blister" type liners which are integrally cast into the aluminum block.

In accordance with this aspect of the invention the inlet-outlet porting is such as to establish a highly effective pressure or velocity pattern developed extending from the back side of the cylinder opposite the exhaust port with generally constant velocity lines extended laterally across the central portion of the piston head and with sides curved toward the exhaust port between the back side or finger port and the exhaust port. The maximum pressure front exists at the finger port which decreases progressively to a maximum negative or downward velocity near the exhaust port to thereby generate a highly efficient scavenging system. The pattern, of course, produces a relatively low load on the charge source as a result of the minimum resistance to flow while maintaining the high input flow thereby effecting efficient scavenging throughout the cylinder to completely expel the exhaust gases without any significant loss of the new charge.

In a preferred and unique porting embodiment the cylinders are provided with individual exhaust passageways which project laterally and downwardly to a manifold exhaust chamber. In a V-engine the exhaust ports also extend inwardly to a central manifold.

An auxiliary transfer or finger port is formed in the aft portion of the cylinder wall and aligned with an opening in the upper portion of the piston to effect and to impart an upward flow to the incoming charge.

A pair of diametrically oppositely located curved input passageways are located generally on a reference plane normal to the line through the plane through the exhaust port and the finger port. The passageway is formed as an outward curved protrusion with a lower inlet portion which communicates through the lower skirt end of the piston to the crankcase for receiving of the compressed charge. The inlet port opening is a more or less rectangular configuration at the cylinder wall. The input port is angularly oriented, with the port wall adjacent the back of the cylinder at a relatively small inclusive angle with respect to a lateral plane through the cylinder. The opposite port wall adjacent to the exhaust port defines a greater inclusive angle with said plane to form a restricted opening. The inlet passageway slowly constricts from the relatively large opening to a minimum cross-section input port into the cylinder to effectively increase the flow velocity while establishing effective directional movement in the cylinder.

Each of the inlet passageways is thus especially constructed to direct the inlet air generally in a common manner into the cylinder and particularly directed toward the outer or aft end of the cylinder opposite that of the exhaust port. The shape and direction of the input passageway and ports to define progressive constriction to increase the velocity of the charge as it moves into the chamber is important to establish the desired speed of charge loop within the cylinder. The charge flows are to the back of the cylinder chamber and then upwardly before looping forwardly and downwardly to the exhaust port to develop a highly efficient loop charging and scavenging of the cylinder. Applicant has found that with the present invention, the charging loop is so highly developed that a simple flat top piston can be readily employed.

Where the cylinders are formed by casting about "blister" type liners, the inlet-outlet and transfer passageways and the input and exhaust ports are defined by the construction of the liner. In particular, the liner includes side protrusions from the cylindrical wall portion. The exhaust port is formed by an appropriately shaped protrusion intermediate the inlet ports with a finger port formed as a small protrusion on the opposite side from the exhaust port. The cylinders in each vertical bank are rotated to align the upper and lower inlet ports of adjacent cylinders and to locate the exhaust passageway projecting downwardly toward the center manifold. The exhaust port projects into the manifold to establish a reliable tuning and super charging of the engine.

The present invention has been particularly employed in construction of a sixty degree V-6 engine for an outboard motor with the cylinder banks separated by 60°.

In a V-6 engine a cylinder will fire every sixty degrees of crankshaft rotation such that all cylinders fire each single revolution. Each of the banks alternately fire and in any single bank the cylinders fire 120° apart. This permits super-charging and optimum tuning of the exhaust system for effective and efficient charging of the cylinders.

The sixty degree V-engine arrangement generally provides an optimum balance between the provision of a compact aesthetic appearing engine with a desirable exhaust and firing order.

Further, the sixty degree V-engine is particularly adapted to a six cylinder engine as the adjacent rods can be closely mounted next to each other upon a common cylindrical crankshaft pin. This permits construction of a very stiff and strong crankshaft with optimum bearing mounting. The sixty degree V-6 engine thus provides a rugged and reliable power source which can be formed as a compact unit and with a more compact and smooth exhaust system which particularly is adapted to tuning of the engine. The novel porting and scavenging construction with the integral case liners permits simplified construction of a multi-cylinder lower case engine. The nested cylinders within the engine block provide a minimum height and, therefore, a desirable aesthetic configuration where high horsepower engines are constructed such as in a multi-cylinder V-6 engine.

The 60° V-6 engine has also been found to produce a high speed and reliable engine for racing of outboards. Such engines are generally run in reverse rotation. It has been found that increased engine efficiency is obtained by using an inverse firing order of a V-6 engine. In a V-6 engine, the cylinders would be normally fired from cylinder 1 to 6 beginning at the uppermost one of the cylinders. The inventor has found, in fact, the in racing engines inverse order of firing 6-1 beginning with the lowermost cylinder and moving upwardly through alternate banks results in improved efficiency. It appears that at the high speeds employed in racing engines, improved supercharging is obtained because the exhaust pulses move downwardly in the same direction as the exhaust gases due in part to downward orientation of the exhaust passages and for approximately two-thirds of the total time of each complete cycle with a noticeable increase in the racing engine power and a distinctly more efficient operation.

The present invention with its various aspects provides a compact cylinder bank with a tuned exhaust system. The loop scavenging by the special passageway construction and with the compact combustion chamber and flat top piston arrangement provides a highly efficient design and therefore should minimize piston burning and the like.

BRIEF DESCRIPTION OF DRAWINGS

The drawings furnished herewith illustrate a preferred construction of the present invention in which the above advantages and features are clearly disclosed as well as others which will be readily understood from the following description.

In the drawings:

FIG. 2 is a horizontal section taken generally on line 5—5 of FIG. 1;

FIG. 4 is an enlarged vertical section through a cylinder generally on line 4—4 of FIG. 3;

FIG. 6 is a vertical section through the cylinder liner, generally on line 6—6 of FIG. 4;

FIG. 7 is a pictorial view of a mold illustrating the shape of the charge inlet passageways shown in FIGS. 4 and 5;

FIGS. 11 - **11*b* are sections of FIG. 7**;

FIG. 13 is a view similar to FIG. 2 illustrating the method of forming the exhaust discharge port; and FIGS. 14–18 are elevational views of a manifold chamber divider.

DESCRIPTION OF THE ILLUSTRATED EMBODIMENT

Figures 1, 5:
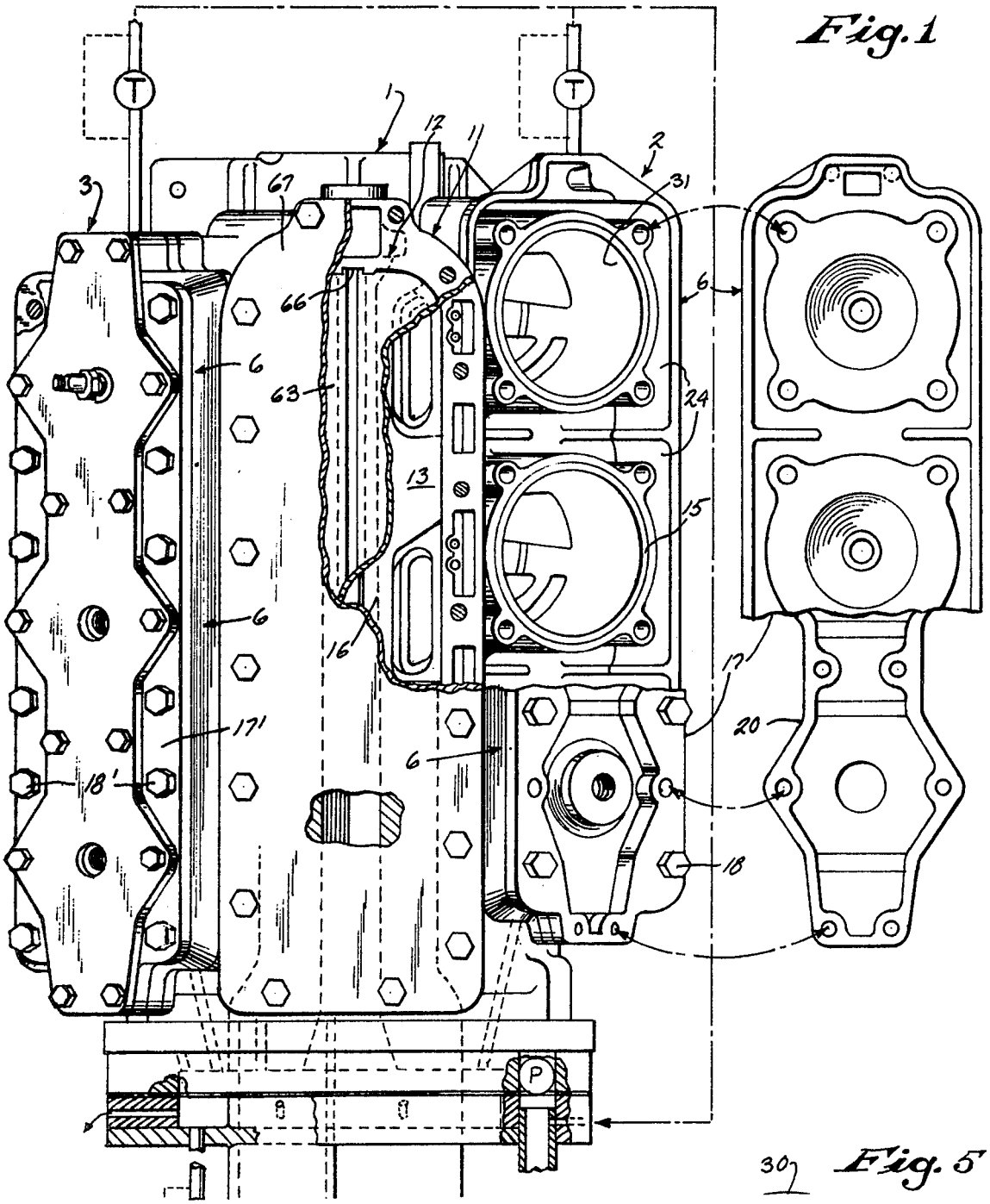
FIG. 1 is a front elevational view of a sixty degree V-6 engine, with parts broken away and sectioned to show certain inner details of construction.
FIG. 5 is a diagrammatic view of a cylinder unit illustrating a loop charging and scavenging.

Referring to the drawings and particularly to FIGS. 1 and 2, a 60° V-6 engine 1 for incorporation in an outboard motor is illustrated. The V-6 engine 1 generally includes a pair of cylinder banks 2 and 3 which are angularly oriented with respect to a crankcase 4 within which a crankshaft 5 is rotatably mounted. The banks 2 and 3 define an inclusive angle of sixty degrees in the illustrated embodiment. Each of the cylinder banks 2 and 3 is also similarly constructed with three vertically in-line cylinder units 6 to form the 60° V-6 engine. Pistons 7 are reciprocally disposed in each cylinder 6. A connecting rod 8 is pinned to piston 7 as at 9 and journaled on a crank pin 10 of the crankshaft 5. The banks 2 and 3 of cylinders 6 are vertically offset with respect to each other to offset the piston rods 8. The degree of offset is preferably such that adjacent piston rods 8 of adjacent or corresponding cylinders 6 of the banks 2 and 3 are mounted on a common cylindrical crank pin 10 of crankshaft 5 to produce a rigid and stiff crank arrangement and also permitting close placement of the cylinders 6 provided by the porting of this invention.

The angular orientation of the cylinder banks 2 and 3 define an exhaust manifold assembly 11 therebetween, which, in accordance with the illustrated embodiment of the invention, is closed by a special T-shaped inner cover 12 dividing the manifold compartment into a pair of separate individual exhaust passageways or chambers 13 and 14, one each for each individual cylinder bank 2 and 3. The separate several cylinder bank exhaust chambers particularly permit the known desirable and effective exhaust pulse tuning of the engine 1.

Each of the cylinder banks similarly includes the three cylinder units 6 and particularly each of the cylinder units 6 is similarly constructed. The one bank 2 is described in detail with corresponding primed numbers used to identify corresponding components of bank 3.

In particular, each cylinder unit 6 includes an open ended cylinder having a liner 15 cast within the block 16. The cylinder opens outwardly of the engine block with the piston 7 reciprocably mounted therein. The bank 2 of cylinder 6 is closed by a cylinder head 17 which is bolted as by bolts 18 in overlying relationship thereto and supports a sparkplug 19 coaxially of the cylinder unit 6 for firing thereof. An outer water cooling jacket cover 20 is secured to the cylinder head 17 with an appropriate opening 21 through which the sparkplug 19 protrudes. The head cover 20 is bolted to the head as by bolts 22 in sealing engagement to define a water cooling chamber 23 connected to a water cooling system including a cylinder water jacket 24 and cast into block 4 and a manifold water jacket 25, preferably as disclosed in Applicant's copending application entitled "V-ENGINE COOLING SYSTEM PARTICULARLY FOR OUTBOARD MOTORS AND THE LIKE" and filed on the same day as this application and assigned to the same assignee.

The present invention is particularly directed to the method of porting of each of the cylinders to define loop charging and scavenging of the cylinder and to the method of forming such porting. Consequently, no further description of the engine is given other than is necessary to clearly and fully explain the present invention.

Generally, as shown in FIGS. 1, 2 and 4, the liner 15 is preformed to define the several charging and scavenging passageways and is integrally cast into the cylinder block or casing 16. The liner 15 in one embodiment is a "blister" type iron liner which is cast within an aluminum block or casing 16.

Generally, in accordance with the particular embodiment of the present invention, as most clearly shown in FIG. 4, the cylinder 6 is provided with a pair of similar novel input port units 26 and 27 for initiating a loop charging flow. Thus input units 26 and 27 are located on essentially, diametrically opposite sides of the cylinder, with an exhaust port unit 28 located centrally therebetween. An auxiliary transfer or finger port 29 is formed to the backside of the cylinder wall opposite the exhaust port for improved forming of the charging and scavenging loop 30, as diagrammatically shown in FIG. 5 and as more fully developed hereinafter. The port units 26 - 28 are located to communicate with the upper cylinder 31 within which ignition occurs and more particularly just above the face 32 of piston 7 at the end of the firing stroke, as shown in FIG. 2.

Generally, as shown in FIG. 5, the charging and scavenging flow of the incoming air-fuel gas mixture, as derived from the pressurized crankcase 4, is directed by ports 26 and 27 as at 33 and 34 toward the aft side cylinder portion 31 and across the top of piston 7 toward the aft end of the cylinder chamber 31. The finger port 29 establishes an upward input flow 35 which merges with the input flow 33 - 34 to cause an upward flow 36 across the backside of cylinder 31 which then loops over and downwardly across the cylinder 31 to exhaust port 28.

Referring particularly to FIGS. 3 - 9, the porting system is clearly shown for the illustrated embodiment of the invention. The liner 15 includes the upper cylinder portion 34 within which the ignition occurs, with the inlet ports or passageway units 26 and 27 integrally formed as curved protrusions between the exhaust passageway unit 28 and the finger port passageway 29, which are similarly formed as appropriate protrusions of the liner below the cylinder portion 31.

Figure 3:
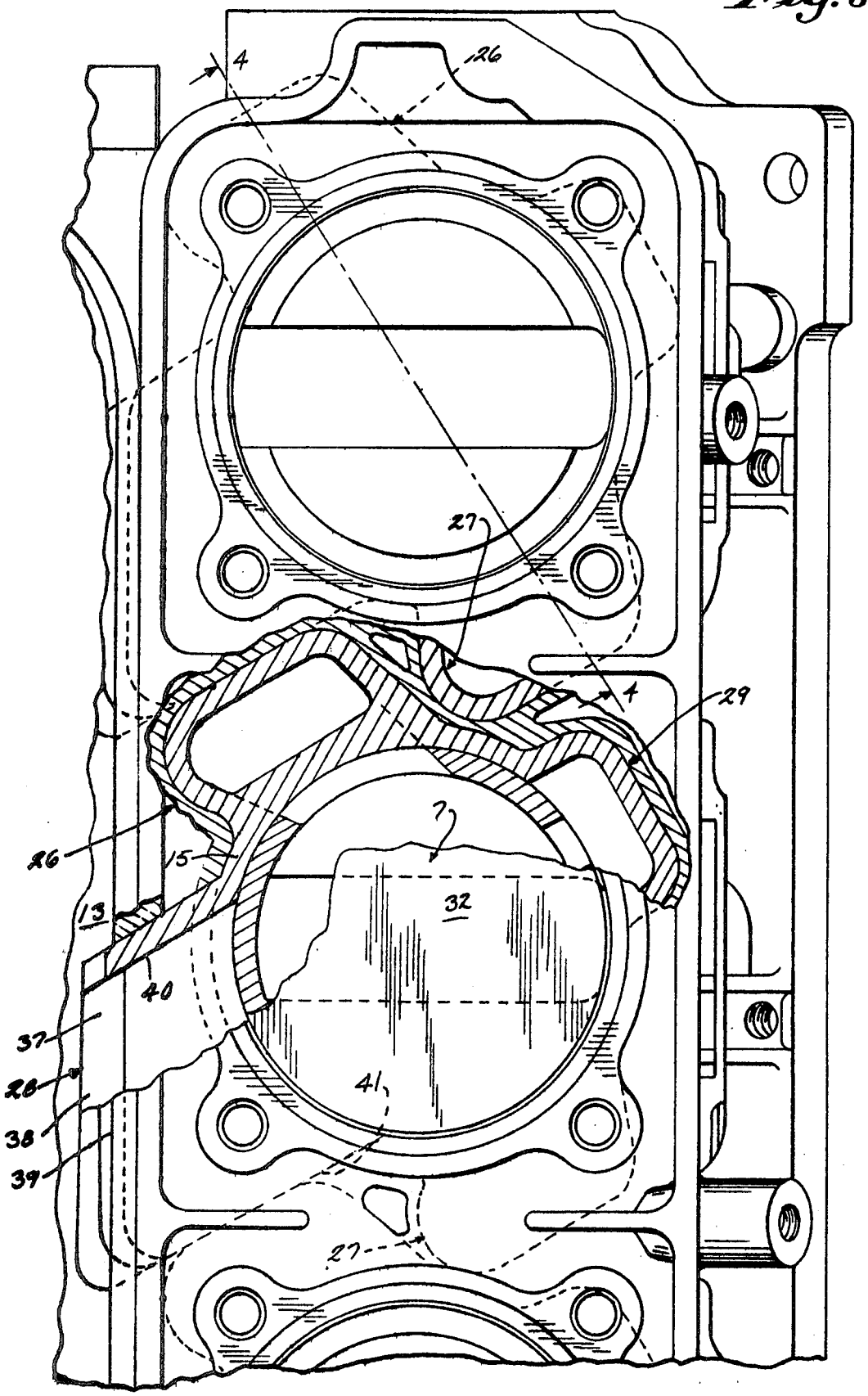
FIG. 3 is an enlarged elevational view of the block showing a pair of the cylinders of the one cylinder bank.
Figure 9:
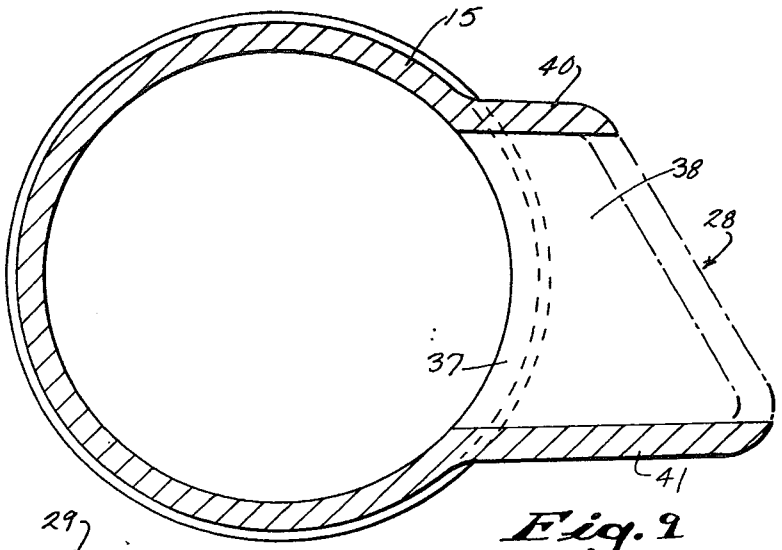
FIG. 9 is a vertical section taken generally on line 9—9 of FIG. 6.

As shown in FIG. 3, the cylinder units 6 in each bank 2 and 3 are similarly, angularly oriented with the exhaust passageway unit 28 angled downwardly from the cylinder to the manifold chamber 13. The inlet port units 26 and 27 which protrude from the cylinder are, as a result of the exhaust unit 28 orientation, rotated from vertical alignment and permit the overlapping of the adjacent input port units 26 and 27 of the stacked cylinder units 6 as shown in FIG. 3. This reduces the height of the engine 1 and also permits close placement of the piston rods 8 for mounting on a common crank pin 10.

The exhaust passageway unit 28 is generally a rectangular passageway which has the exhaust port 37 opening directly into the cylinder along a plane essentially normal to the axis of the cylinder. The passageway 28 extends from port 37 and is angularly oriented with parallel front and back walls 38 and 39, a relatively short upper wall 40 and a relatively long bottom wall 41, such that exhaust gases exiting from cylinder 31 are directed downwardly and laterally into the exhaust manifold chamber 13. As shown in FIG. 2, the compact V-6 engine results in the close location of the inner cylinder wall and adjacent manifold wall as common short wall portion 41*a*.

In supercharging, a portion of the fresh charge introduced into the cylinder for scavenging moves into the exhaust passageway and is returned to the cylinder by the exhaust pressure pulse of a companion cylinder. In the illustrated embodiment of the invention, the exhaust tubes and passageways 28 have top and bottom end wall portions 41b projecting into the manifold chamber to aid in retention of such fresh charge. In an early construction of the engine, with the passageway 28 formed flush with the base of the chamber 13, the shortened length of the exhaust passageway appeared to allow the fresh charge to rapidly diffuse into the exhaust chamber before it could be forced back into the cylinder. The extended passageway produced a distinct increase in power without increase in fuel flow. The extended passageway can be readily formed, for example, as more fully described hereinafter.

The inlet passageway units 26 and 27 are similarly constructed as most clearly shown in FIGS. 3 – 10. Thus, referring to inlet passageway unit 26, it includes a curved passageway having a large inlet opening 42 at the lower end of the cylinder and curving outwardly and upwardly to the inlet port 43 spaced from the inlet opening by the dividing wall 44. The port 43 is located to the top side of exhaust port 37. The port 43 is generally rectangular with relatively wide or long circumferential dimension and a relatively narrow or short axial dimension. The height is generally one-half that of the exhaust port 37 and is axially aligned with the lower half of the exhaust port. The passageway unit 26 is further especially constructed to create a smooth flow of the inlet charge at an increasing velocity and is angularly oriented to direct the charges toward the back wall of the cylinder 31.

Figure 8:
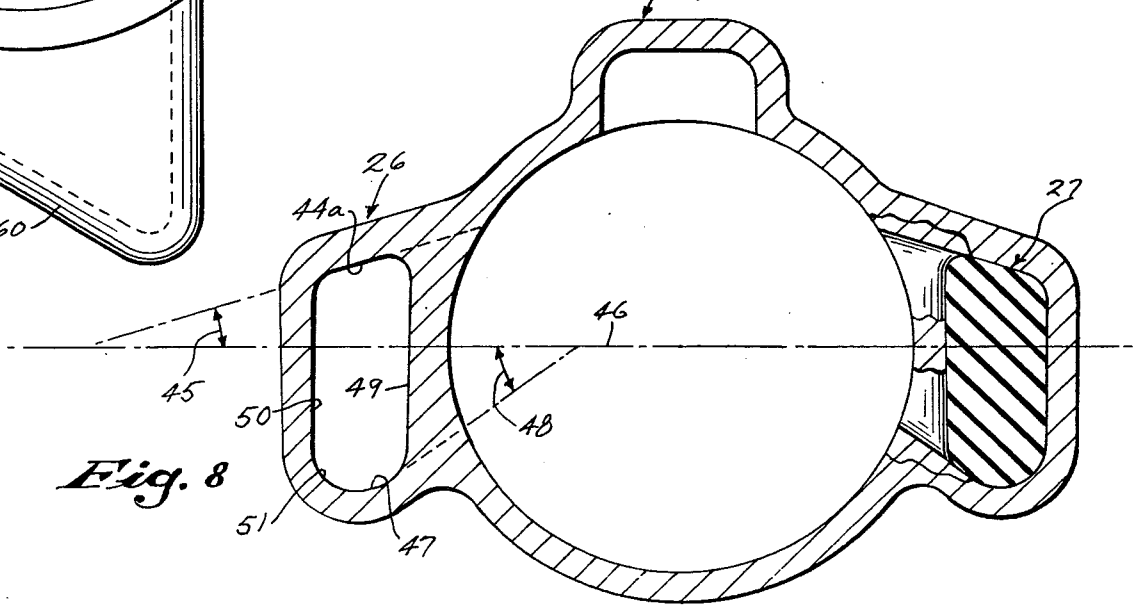
FIG. 8 is a vertical section taken generally on line 8—8 of FIG. 4.

In particular, the inlet passageway unit 26 includes a side wall 44a nearest the boost port 29 which is angularly oriented to the side of the cylinder opposite the exhaust port and with a relatively small inclusive angle 45 with respect to a reference plane 46 (FIG. 8) through the inlet ports 43 and 43'. The opposite inlet side wall 47 of the inlet passageway is located to the opposite side of plane 46 and is angularly oriented with a significantly larger inclusive angle 48 with respect to the reference plane 46. The flow plane progressively changes therebetween. Further, the passageway 26 has a generally rectangular cross-section with the side walls 44a and 47 joined to an inside wall 49 at the bridge section 49a and an outside wall 50. The wall 49 is relatively short as a result of the large inlet opening 42 while the outside wall 50 is, of course, large. The walls 44 and 47 are generally flat walls which are further angled or offset toward each other from the lower ends at opening 42 to the upper ends at the port 43 to define a gradual lateral constriction as well as a significant depth restriction between the large inlet opening 42 and the small port 43. The several walls 49 and 50 are not flat but are distinctly curved with smooth curved connecting edges as at 51 to define a smooth flow pattern and with the inlet port 43 essentially having a rectangular cross-section. The passageway 26 thus defines a gradually constricted cross-section to the inlet port 43 at the cylinder wall for the incoming charges which are then directed toward the wall of the cylinder opposite the exhaust port. For example, the wall 44a has been formed essentially at an angle of 17° to the reference plane 46 while the front wall 47 has been formed with an exclusive angle of 39° to the plane 46, as seen in FIG. 8. The opening as applied to a 3.125 gauge diameter cylinder is located in the wall 44 of the port 43 0.8 inches to the inlet side of the reference plane 46 and the wall 47 is similarly terminated and located at 0.1530 inches to the leading opposite side of the reference plane 46.

As more clearly shown in FIG. 4, the top and lower wall of the passageway 26 immediately adjacent the inlet port 43 preferably project slightly upwardly to impart a slight initial upward bias to the input charge 33. The inlet port unit 27 is similarly constructed and corresponding components are identified by corresponding primed numbers.

The input charges 33 and 34 from the opposed inlet passageway units 26 and 27 are simultaneously introduced into the cylinder 31 with an essentially similar direction of the charges toward the aft and center of the cylinder impacting adjacent to the center plane between the input ports and at the boost port unit 29.

The boost port 29 is formed as a sidewall depression with tapered sidewalls 52 and 53 extending from the lower end to a slightly wider upper end. The port 29 is generally a shallow, dished-shaped recession having a back wall which curves axially to an upper circumferential straight wall 54 and having slightly inwardly curved sidewalls 52 and 53. The upper wall 54 is also located in the same diametrical plane as the upper edges or wall of the inlet ports 43 and 43'.

The input charge is developed within the crankcase 4 in the usual manner and introduced into the several passageway units 26, 27 and 29, through appropriate openings in the piston 7.

Thus, as shown in FIG. 2, the piston 7 will include a sidewall opening 55 aligned with finger port 29 and edge skirt openings 56 and 57 aligned with inlet units 26 and 27. The impacting charges engage and mix with charge 35 from the finger port 29 with a resulting loop flow 30 of the charge. Thus, the charge fuel mixture sweeps across the top of the piston 7 and upwardly over the back side of the cylinder wall and then looping over and downwardly of the cylinder to the exhaust port. This develops an essentially typical loop charge path 30 across the flat face 32 of piston 7. The particular varying angled sides of the input ports and the location relative to the exhaust port and the finger port develops a highly efficient loop charge scavenging of the cylinder. Although a usual special headed or faced piston employed in loop charging may be employed, the inventor has found that the present invention develops such effective charging and scavenging that such is not required and that the relatively inexpensive flat faced piston may be employed. This, of course, reduces the original cost as well as maintenance cost of the loop system.

Figure 12:
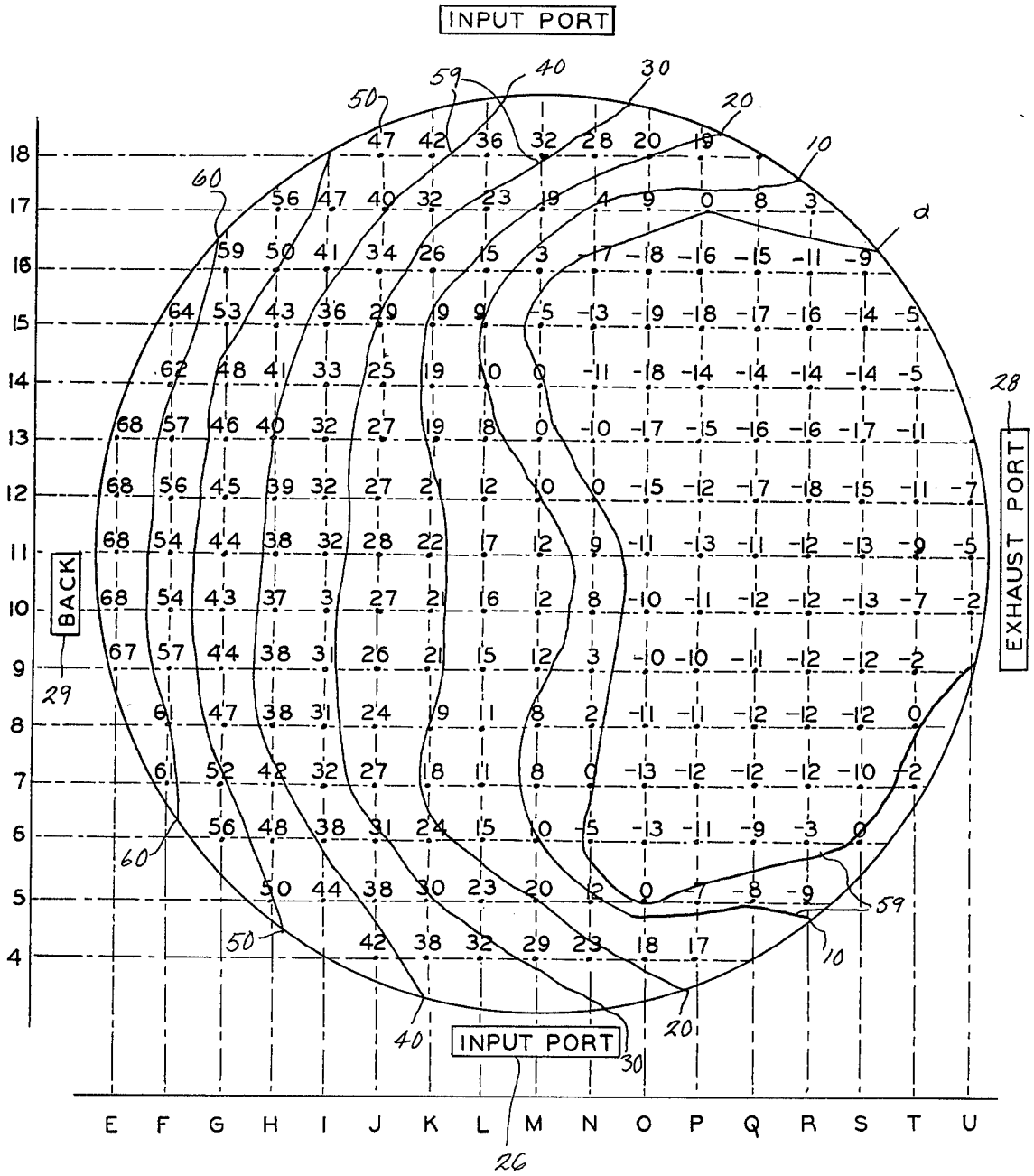
FIG. 12 is a diagrammatic illustration of a Jante graph illustrating the velocity pattern developed across the cylinder and the head of the piston during a charging and scavenging cycle.

Tests conducted on a cylinder liner of the invention have developed a Jante curve, as typically shown in FIG. 12 which illustrates a velocity pattern within the cylinder portion 30 and across the head mounting face of the open cylinder.

As clearly illustrated in FIG. 13, a maximum velocity is developed along the backside of the cylinder 31 with a progressively decreasing velocity, developing a negative or downward velocity at the exhaust port 37. Generally, the pressure pattern across the cylinder between the two inlets 43 and 43' is a relatively flat pattern of lines 58 across the cylinder with the ends of the pressure lines curving toward the exhaust port 37 as at 59. This develops a highly optimum type of scavenging and charging of the cylinder particularly and is typical of the desired pattern associated with highly effective and efficient scavenging and charging of the cylinders.

Further, the exhaust gases move downwardly into the manifold chambers 13 and 14 and are thus moving in the direction of discharge to and through the lower unit, not shown.

In racing engines which are run in a reverse rotation, the engine efficiency was found to improve by inverting of the firing order. Referring to FIG. 1, the normal firing order would begin with the uppermost cylinder unit 6, which is the top unit in bank 2, and then move downwardly, alternating banks 2 and 3, to the lowermost cylinder unit 6, which is the bottom unit 6 in bank 3. Tests of a racing engine have shown an increase in efficiency and an increase in power on the order of 4 percent. The movement of the supercharging exhaust gas pulses in the direction of the exhaust gas travel for two out of three cylinders being charged in each firing sequence appears to be a source of increased efficiency.

The present invention thus includes various novel aspects and features which are uniquely adapted to provide an efficient and reliable V-engine and particularly a 60° V-6 engine. However, the several features may be employed in any other V-engine and further may also be advantageously used in an in-line engine. For example, the loop scavenging and charging system is advantageously applicable to any two-cycle engine and particularly multiple cylinder engines.

Figure 10:
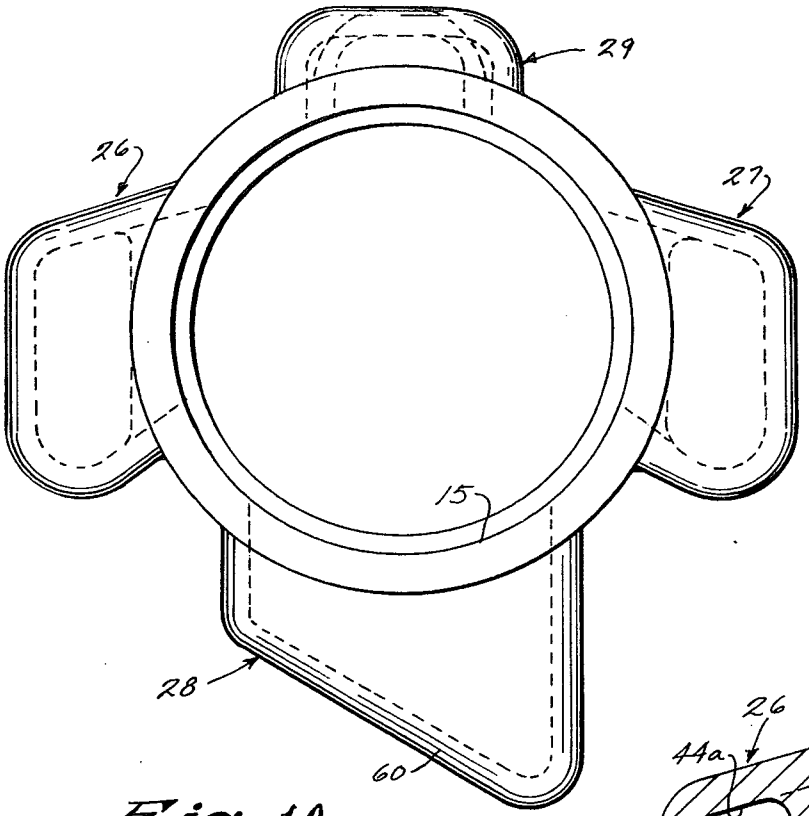
FIG. 10 is a top plan view of a cylinder liner.

The illustrated embodiment of the invention with the integral cast liners and the single cast manifold chamber also permits a unique method of forming the exhaust passageway openings in the manifold chambers 13 and 14. In this aspect of the invention the exhaust passageway unit 28 of liner 15 is formed as a closed end member with an integral, outer end wall 60, as shown in FIG. 10. The aluminum block 16 is cast about the liner 15 including the closed end wall 60 of the exhaust passageway. The rough cast block appears generally as shown in FIG. 13 with the outer wall 60 located within the manifold chamber and, in particular, with the upper edge outer wall 60 and the top wall 39 embedded within a continuous base wall 61 of the manifold. The separate chambers 13 - 14 of the completed engine are cast or formed as a single open chamber 62. This construction permits the location of a milling cutter 63 properly angled into the chamber 62 and particularly into alignment with the top, outer corner of the closure wall 60 and the top wall 39 of the exhaust passageway unit 28.

The milling cutter 63 is located to one end of the chamber 62 and in alignment with the aligned cast exhaust passageways for one bank of cylinders. A single pass of the milling cutter 63 provides simultaneous removal of the cast metal 61 and the liner 60 to open the exhaust passageways for the cylinder bank to the manifold chamber.

The milling cutter 63 or other tool is then reversely positioned and similarly aligned with the exhaust port units of bank 2 to chamber 14 on the opposite side of the common cast chamber 62 to correspondingly open the three exhaust passageways of the opposite cylinder bank.

The open chamber 62 has been found to provide an improved and inexpensive means of forming the exhaust port opening for the V-6 engine wherein the individual exhaust chamber particularly restricts the opening and access to exhaust passageways.

As shown in FIG. 13, and previously discussed, the exhaust passageways 28 are preferably formed projecting into the exhaust chambers 13 and 14. Thus, the milling cutter 63 or any other appropriate tool used will be aligned with the closed, cast port 28, run in sufficiently to open the end of the passageway, without removing the inwardly projecting sidewalls and then withdrawn and moved into lateral alignment with an adjacent exhaust port.

Where the supercharging action is not employed or considered significant, the several exhaust passageways may of course be very simply formed by providing a single depth cutting pass from one end of the exhaust chamber to the other.

In order to establish the necessary, separate manifold chambers for effective and best tuning of the engine and the like, the manifold cover 12 is especially formed with a T-shaped cross-section, as shown in FIG. 2, and FIGS. 14 - 18 inclusive with an outer flange bolted or otherwise firmly affixed to the cylinder block and bolted to the block flange. The T-shaped cover 12 includes an outer plate portion 64 overlying the chamber 62 and a centrally located stem 65 which projects downwardly to the base of the chamber to define chambers 13 and 14. The stem 65 extends throughout the chamber and preferably is provided with a slot and projection interlock along the base as at 66 and the ends as at 67 to securely separate the chamber into the pair of separate exhaust manifold chambers 13 and 14, one for each of the cylinder banks 2 and 3.

The T-shaped cover 12 is formed with the upper ends of the plate portions 64 curved downwardly to the base of the exhaust chamber at the upper ends of chambers 13 and 14 as at 68 and 69 to properly shape the upper ends thereof with respect to the uppermost cylinder units 6. Thus, curved portion 68 for the lower bank 3 is located slightly below portion 69 to compensate for the offset of the cylinder bank. The lower ends are also slightly curved to merge with the exhaust openings formed in the lower face of the block 16.

In the illustrated embodiment of the invention the T-shaped member 12 is covered by a slightly dished manifold cover 70 defining a water cooling chamber therebetween. The cover and member are bolted to the manifold chamber wall in accordance with usual practice. The cooling system is preferably a series system as disclosed in the previously identified copending application.

Thus, the cover with the dividing wall and the common cast chamber supplies a very simple and inexpensive construction particularly adapted for mass producing the V-6 engines for outboard motors and the like.

The present invention, therefore, provides various unique and significant features and particularly a highly efficient and practical loop charge porting construction and arrangement which is adapted to two-cycle engines. The invention is particularly adapted and provides a further unique feature when incorporated in a 60° V-6 engine for an outboard motor. The illustrated engine discloses practical, novel embodiments of the invention, which may, of course, be otherwise constructed within the teachings of this invention.

Various modes of carrying out the invention are contemplated as being within the scope of the following claims, particularly pointing out and distinctly claiming the subject matter which is regarded as the invention.

I claim:

1. A two-cycle V-engine having a plurality of in-line cylinders in a pair of angular oriented banks with an exhaust chamber located between said banks with a common wall between the cylinders and the exhaust chamber, each of said cylinders having a head located at a defined head end portion and having circumferentially spaced inlet and outlet port means, a reciprocating piston in each of said cylinders characterized by a loop charging and scavenging apparatus wherein said port means comprise an exhaust port unit located in said common wall and extending from the cylinder through said common wall into the exhaust chamber and extending longitudinally of the banks of cylinders toward one end of said banks of cylinders, said exhaust chamber exiting from said one end of the engine, a pair of oppositely located inlet port units for supplying of inlet gases to each cylinder, each of said inlet port units having an inlet port including essentially linear sidewalls which are substantially differently angularly oriented with a progressively converging angle of flow from the back of the port to the front and a discharge opening of the port unit to direct the inlet gases across the cylinder with an angle of impact adjacent the wall of the cylinder opposite said exhaust port unit and moving outwardly to the head of the cylinder and across the top of the piston toward said exhaust port unit and then moving from the head in the opposite direction and toward the exhaust port unit in the general form of a loop to define loop charging and scavenging of the cylinder.

2. The V-engine of claim 1 including said pistons having essentially planar end faces.

3. The V-engine of claim 1 including a finger port opposite said exhaust port unit to establish an auxiliary charge, said finger port being angularly located to direct the auxiliary charge toward said head and merging with the charges from the inlet port units.

4. The V-engine of claim 1 wherein said engine includes a cast block, each of said cylinders including an individual "blister" iron liner embedded in the block, said liner having preformed inlet and exhaust port units.

5. The V-engine of claim 2 wherein said exhaust port is spaced toward the head from the piston face with the piston located in maximum spaced relation to the head at the end of the exhaust stroke, said inlet ports being circumferentially aligned with each other and the exhaust port and having an axial depth of about one-half of the exhaust port, and said exhaust port being located to open prior to the inlet ports and aligned with the inlet ports to simultaneously open the exhaust port and inlet ports during the final portion of the exhaust stroke of the engine.

6. The two-cycle V-engine of claim 1 wherein each of said inlet port units includes a continuously curved inlet passageway having a large inlet opening adjacent the engine crankcase connected to said inlet port, said passageway having a progressively restricted cross-section to the inlet port to progressively increase the velocity of the charge, and said inlet port having a smaller cross-section than said passageway.

7. The two-cycle V-engine of claim 6 wherein said inlet opening is a generally rectangular opening having a greater axial length than circumferential length and said inlet port is a generally rectangular opening having a greater circumferential length than axial length.

8. The two-cycle V-engine of claim 7 wherein said inlet port has curved sidewalls connecting an essentially flat top wall with a convex bottom wall, said inlet port being angled slightly to the head end of the cylinder.

9. The two-cycle engine of claim 1 wherein said banks have said cylinders vertically stacked and each of said pair of inlet port units are rotated to lie at an angle from the vertical cylinder alignment and forming an upper inlet unit and a lower inlet unit, said cylinders being mounted in adjacent relation with the upper inlet port unit of a lower cylinder adjacent to the lower inlet port unit of an upper cylinder.

10. The two-cycle engine of claim 1 wherein said banks have said cylinders vertically stacked and said exhaust port units include parallel top and bottom walls and parallel sidewalls defining a rectangular passageway, said bottom wall being substantially longer than said top wall, said top wall having the cylinder end located generally in the horizontal center portion of the cylinder and said bottom wall having the cylinder end located generally in the vertical center portion of the cylinder to direct the exhaust gases downwardly into said exhaust chamber.

11. The two-cycle engine of claim 10 wherein said pair of inlet ports of each cylinder includes a top inlet port adjacent the top wall of the cylinder and a lower inlet port adjacent the bottom wall of the cylinder, said top and lower inlet ports of adjacent, in-line cylinders in each bank being located to the opposite sides of a central vertical plane through the center of the cylinder bank and located in overlapping relationship.

12. The two-cycle V-engine of claim 1 wherein said inlet gases develop an essentially constant velocity line across the top of the piston with a maximum velocity at the outer wall opposite to the exhaust port, the amplitude of said velocity lines decreasing and then becoming negative or downward to the exhaust port unit.

13. The engine of claim 12 wherein the velocity lines adjacent the sidewalls decrease toward the exhaust port unit.

14. The two-cycle V-engine of claim 1 having a pair of vertically oriented cylinder banks each of which includes a correspondingly spaced plurality of in-line and vertically spaced cylinder units, said cylinder banks being vertically offset, and said cylinder bank being alternately fired and said cylinders being sequentially fired form the bottom to the top, the lowermost cylinder being fired as number 1 in each firing sequence.

15. In a 60°, two-cycle V-engine having a pair of vertically oriented cylinder banks each of which includes a correspondingly spaced plurality of in-line vertically spaced cylinder units each having a cylinder head and characterized by a loop charging and scavenging system for each cylinder comprising an exhaust port unit at the inner wall of the V-engine and extending downwardly from the lower inner portion of the cylinder and a pair of inlet port units located one each to the opposite sides of the exhaust port unit, said inlet port units establishing angularly directed charge toward the back of the cylinder and generating an charge flow over the back wall to the head of the cylinder which loops back and downwardly to the exhaust port unit.

16. In the 60°, V-engine of claim 15 wherein said cylinder banks are alternately fired and said cylinders being sequentially fired from the bottom to the top, the lowermost cylinder being fired as number 1 in each firing sequence.

17. In the 60° engine of claim 15 having a manifold exhaust chamber between said cylinder banks, said cylinders having exhaust passageway means extending laterally and downwardly from the cylinder to the exhaust chamber.

18. In the 60° engine of claim 17 wherein each bank includes three cylinders producing a V-6 engine, said exhaust chamber being centrally divided to define individually tuned exhaust passageways for each cylinder bank.

19. A 60° two-cycle V-engine having a pair of vertical cylinder banks including an angle of 60° and each of which includes correspondingly spaced pluralities of in-line cylinders having a discharging exhaust chamber between said banks, with a bottom discharge opening, said exhaust chamber being connected in a tuned exhaust system, said banks being vertically offset to locate the piston rod for attachment to a common crankshaft, said cylinder bank being alternately fired and said cylinders being sequentially fired from the top of the bottom, the uppermost cylinder being fired as number 1 in each firing sequence, each of said cylinders having an exhaust passageway means extending laterally and downwardly from the lower inner portion of the cylinder to the exhaust chamber, and having a pair of angularly oriented inlet port units to the opposite side of the exhaust port unit to direct the flow toward the aft side of the cylinder to define a loop charging and scavenging flow, said port units formed as protrusions from said cylinders and being rotated to nest the adjacent inlet port units of adjacent cylinders.

20. In a two-cycle engine, an open-ended cylinder formed in an engine cylinder block and closed at one end by a head and having a piston reciprocally mounted in the cylinder, said cylinder block having circumferentially spaced inlet and outlet port means arranged to create a loop charging and scavenging of the cylinder from a pressurized chamber at the end of the cylinder opposite said head, characterized by an exhaust port unit located in the block for exhausting gases from the cylinder, said port unit having an exhaust port terminating in the cylinder and located to be completely uncovered with the piston at maximum spacing from the head and to be progressively covered during the movement of the piston from said position, a finger port in the cylinder diametrically opposite the exhaust port, a pair of inlet port units located one each to the opposite sides of the finger port, each of said inlet port units having a passageway extending through the block parallel to the cylinder and coupling the pressurized chamber to the cylinder, said inlet port units being located on diametrically opposite sides of the cylinder and essentially equicircumferentially spaced from the exhaust port and the finger port, said inlet port units each having an inlet port having essentially straight sidewalls which are substantially differently angularly oriented with a progressively converging angle of flow directing the charge from said ports toward the finger port with an angle creating impact adjacent the finger port said finger port introducing a charge merging with the flow from the inlet ports and moving from the ports to the head of the cylinder and then from the head of the cylinder to said exhaust opening in the general form of a loop to define loop charging, wherein said passageway of each of said inlet port units has a large inlet opening adjacent the crankcase and is connected to said inlet port by a sharply curved front wall and a slowly curved back wall, said walls being joined by sidewalls and defining a progressively restricted opening to said inlet port.

21. The engine of claim 20 wherein each of said pistons has an essentially planar end face.

22. The engine of claim 20 wherein said block is a cast aluminum block, each of said cylinders including an individual "blister" iron liner embedded in the aluminum block, said liner having preformed inlet and exhaust port units.

23. The engine of claim 20 wherein said side wall of said inlet port adjacent to the finger port defines an inclusive angle of approximately thirty-nine degrees with a reference plane passing through the center of the cylinder and the inlet ports and the second of said sidewalls adjacent to the exhaust port defines an inclusive angle of approximately seventeen degrees with said reference plane.

24. The engine of claim 20 wherein said inlet gases develop an essentially constant velocity line across the cylinder with a maximum velocity at the outer wall opposite to the exhaust port, the amplitude of said pressure lines decreasing to the exhaust port unit.

25. The engine of claim 24 wherein said velocity lines curve at the cylinder wall adjacent the inlet ports toward the exhaust port unit.

26. The engine of claim 20 having a plurality of in-line vertically stacked cylinders, said exhaust port units extending laterally and downwardly of said cylinders, each of said pair of inlet port units are rotated to lie at an angle from the vertical cylinder alignment with an upper and lower inlet port unit, said cylinders being mounted in adjacent relation with the upper inlet port unit of a lower cylinder adjacent to the lower inlet port unit of an upper cylinder.

* * * * *

UNITED STATES PATENT AND TRADEMARK OFFICE

CERTIFICATE OF CORRECTION

PATENT NO. : 4,092,958

DATED : June 6, 1978

INVENTOR(S) : DAVID JERRY HALE

It is certified that error appears in the above-identified patent and that said Letters Patent are hereby corrected as shown below:

| | | | | |
|---|---|---|---|---|
| ABSTRACT | , | Line | 4, | after "differently" cancel "angles" and insert --- angled ---; |
| Column | 1, | Line | 40, | beginning of the line, cancel "through" and insert --- though ---; |
| Column | 4, | Line | 64, | after "cycle;" cancel "and"; |
| Column CLAIM 14 | 12, | Line | 37, | after "fired" cancel "form" and insert --- from ---; |
| Column CLAIM 15 | 12, | Line | 51, | after "generating" cancel "an" and insert --- a ---; |
| Column CLAIM 19 | 13, | Line | 10, | after "top" cancel "of" and insert --- to ---. |

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*